US011801992B2

(12) United States Patent
Irarrazaval Mendez et al.

(10) Patent No.: US 11,801,992 B2
(45) Date of Patent: Oct. 31, 2023

(54) FLOATING DEVICE FOR THE CONSTITUTION OF A FLOATING COVER

(71) Applicant: INVERSIONES IRASO II LTDA., Santiago (CL)

(72) Inventors: Tomás Irarrazaval Mendez, Santiago (CL); Matías Signoro Duque, Santiago (CL)

(73) Assignee: INVERSIONES IRASO II LTDA., Santiago (CL)

( * ) Notice: Subject to any disclaimer, the term of this patent is extended or adjusted under 35 U.S.C. 154(b) by 151 days.

(21) Appl. No.: 17/420,547

(22) PCT Filed: Jan. 3, 2019

(86) PCT No.: PCT/IB2019/050057
§ 371 (c)(1),
(2) Date: Jul. 2, 2021

(87) PCT Pub. No.: WO2020/141353
PCT Pub. Date: Jul. 9, 2020

(65) Prior Publication Data

US 2022/0119193 A1 Apr. 21, 2022

(51) Int. Cl.
*B65D 88/34* (2006.01)

(52) U.S. Cl.
CPC ..... *B65D 88/34* (2013.01)

(58) Field of Classification Search
CPC ..... B65D 88/34; B65D 88/50; B65D 88/38; B65D 90/34; E04H 4/06; B63B 35/44
USPC ..... 220/215
See application file for complete search history.

(56) References Cited

U.S. PATENT DOCUMENTS

2010/0326342 A1* 12/2010 Alirol ..... B63B 3/06 114/267
2011/0215097 A1* 9/2011 Archie, Jr. ..... A45C 11/20 29/428
2017/0253426 A1* 9/2017 Boyer ..... B65D 88/36

FOREIGN PATENT DOCUMENTS

| | | | |
|---|---|---|---|
| EP | 1771359 | B1 | 6/2013 |
| ES | 1057093 | U | 6/2004 |
| JP | 2006089122 | A | 4/2006 |
| WO | WO1998012392 | A1 | 3/1998 |
| WO | WO2011035362 | A1 | 3/2011 |

* cited by examiner

*Primary Examiner* — Anthony D Stashick
*Assistant Examiner* — Raven Collins
(74) *Attorney, Agent, or Firm* — CALDERON SAFRAN & COLE PC; Corinne Marie Pouliquen

(57) ABSTRACT

A floating device to be used in groups to form a floating cover that floats over volumes of water or liquids used in industry, mining and agriculture, directed to reduce evaporation, algae formation and gas emanation. The device comprising an outer shell consisting of outwardly convex covers and lateral edges that have a polygonal shape in a plan view, vertical wall surfaces extending from the edges of the covers, wherein each vertical wall surface joins at the level of the middle plane of the device with the edges of an inner shell.

10 Claims, 4 Drawing Sheets

FLOATING DEVICE FOR THE CONSTITUTION OF A FLOATING COVER

CROSS-REFERENCE TO RELATED APPLICATIONS AND CLAIM TO PRIORITY

This application is a national stage application of International Application No. PCT/IB2019/050057 filed Jan. 3, 2019, the disclosures of which are incorporated herein by reference and to which priority is claimed.

FIELD OF THE INVENTION

The present invention relates to the storage of water volumes to be used in industry, mining and agriculture. In particular, the present invention relates to a floating device and a corresponding floating cover, to be used in volumes of water or liquids, with the aim of reducing evaporation, formation of algae and the emanation of gases.

BACKGROUND OF THE INVENTION

In general, floating covers of the state of the art are formed by grouping floats on the surface of a body of water. Their main goal is to reduce the evaporation of water or liquids accumulated in the open air, which in some cases is associated with gas emanations. These devices can also be applied to volatile substances that are not necessarily found in the open air. In addition, its use turns difficult the contact between the fauna of the area and the volume of protected liquid. Its use is especially observed in industry, mining and agriculture.

Currently, most evaporation control devices use the hexagonal configuration, as it allows adequate coverage of the surface when grouped. However, several problems affecting the effectiveness of the floating cover formed are partially addressed, without integrating all relevant aspects. To name a few, with respect to materiality, when these devices are white the radiation is capable of passing through the float, stimulating the formation of algae, similar to a greenhouse; additionally, some devices are manufactured in Polypropylene (PP) and when faced with high temperature variations they tend to fracture. Regarding the size of the float and its stability, the small ones are usually very light and unable to remain stable under strong winds of great magnitude; while others have a high ballast weight (for example, around 80 kg) that has as a consequence the tendency to fracture when colliding with each other, as a result of the winds. With respect to the effectiveness to avoid the evaporation of the liquid, several models include a perforation in the upper and lower area of the float and maintain an amount of the liquid to protect inside, as a result of the radiation that liquid is heated and then released to the atmosphere as vapor, and this evaporation is a constant process. The management of rainwater is another issue that must be addressed, since rainfall produces vertical forces that are capable of totally or partially sink a float, in the best case causing the entire body of water to be unprotected. Generally, this is addressed with complex devices in their design, which results in problems in manufacturing, transporting and the final use of the device. Related to the above, devices designed without a horizontal symmetry tend to decrease their functionality as a result of the float overturning, which can occur when facing strong winds or in the process of arranging the floats on the body of water. These devices require greater supervision as they can suffer a significant loss in efficiency or, for example, sinking due to a subsequent rain.

Among the prior art publications reference is made to document WO1998012392. This document claims a floating body to reduce evaporation from a tank or reservoir of fresh water that has a polygonal shape, side faces with vertical walls that are partially submerged in the water, a top cover with smooth curvature and a hole in the upper part, and buoyancy means located under the top cover and inside side faces of the floating body. In this case, the water entering the floating body finds favorable conditions for its evaporation and exit through the upper hole, along with promoting the formation of algae.

Document WO11035362A1 is also referenced, which claims a floating module to form a cover in a body of water. The module has a hexagonal shape, an upper cover and a lower cover defining a chamber between them, holes are provided in the lower cover that allow the entry of water and in the upper cover to allow the exchange of air, and a plurality of floating cells that are held in place due to the covers. The floating cells disclosed are spheres arranged at the vertices of the hexagon. Similar to the previous document, the water inside the chamber works as ballast, and it also receives heat producing evaporation that can escape through the holes in the upper cover.

Regarding the materiality of the devices of the state of the art, document EP1771359B1 describes a floating device made from waterproof multifilament polypropylene that incorporates an additive, particularly a UV filter. The UV filter provides resistance to the solar radiation, extending the useful life, but it does not prevent the float cover from heating up and radiating the heat towards the interior.

SUMMARY OF THE INVENTION

An objective of the present invention is to provide a device to reduce the losses of liquid by evaporation in volumes of water or liquid, both natural and artificial, and that can operate under extreme weather conditions, such as strong winds and high variations in temperature. Especially, emphasis is placed on the thermal insulation characteristics that are provided to the protected body of water or liquid, and particularly to the volume of liquid that is used as ballast.

Another objective of the present invention is to allow the precipitation or the liquid that may fall on the float to be conducted and carried to the body of water, thereby avoiding its accumulation or evaporation over the float.

The device must also be compatible with both alkaline or acid volumes of water or liquids, as well as those with salinity.

A floating device is provided to be used in volumes of water or liquids for industrial purposes, with the aim of reducing evaporation, algae formation and gas emanation. The device has a symmetrical polygonal shape with an inner shell filled with air, which works as a thermal insulator and provides buoyancy to the device, and an aerodynamic outer shell that allows grouping the multiple devices in the volume of water or liquid when interacting with the wind to form a floating cover.

The device also has a plurality of perforations that allow to use the storage liquid to provide a sufficient weight to tolerate winds of up to 120 km/h. Because its manufacture comprises at least one polymer selected from polypropylene or polyethylene together with additives to resist UV radiation, the floating device is able to tolerate high or low pH, strong temperature gradients and exposure to solar radiation.

In addition, due to its shape, the device is capable of capturing precipitation and directing it to the protected liquid.

DETAILED DESCRIPTION OF THE PREFERRED EMBODIMENT(S)

The invention refers to a device to be used in volumes of water or liquid for industrial purposes, mining and agriculture, which is formed as a floating cover by grouping a multiplicity of devices in order to reduce evaporation, algae formation and gas emanation. A detailed description of some of the main embodiments is provided herein, however, modifications or combinations can always be incorporated without departing from the scope of the invention.

Figure 1:
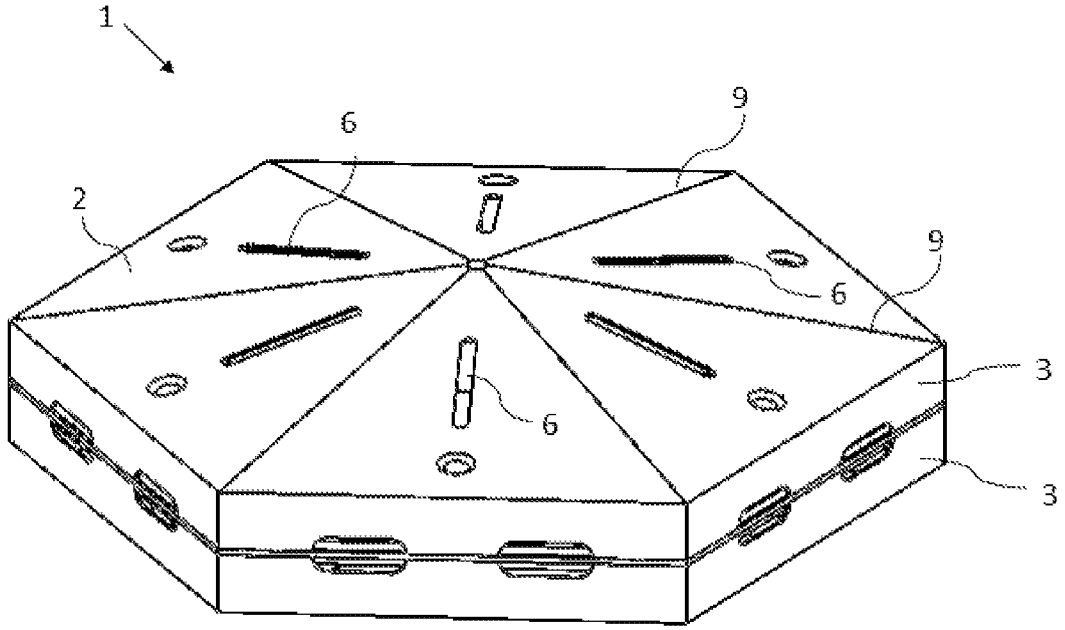
FIG. 1 illustrates a perspective view of an embodiment of the floating device according to the present invention.

FIG. 1 illustrates a preferred embodiment in which the hexagonal shape of the device (1), the convexity of its covers (2) and the use of lateral edges formed by vertical wall surfaces (3) can be seen.

Figure 2A:
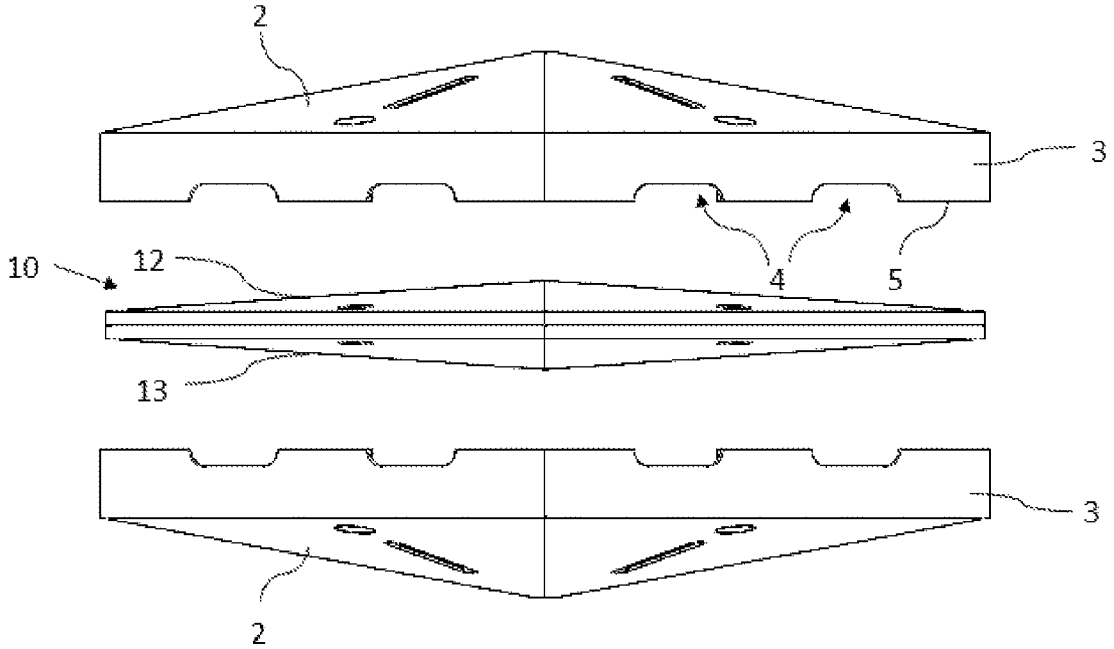
FIGS. 2A and 2B illustrate exploded elevation and perspective views of the floating device.
Figure 2B:
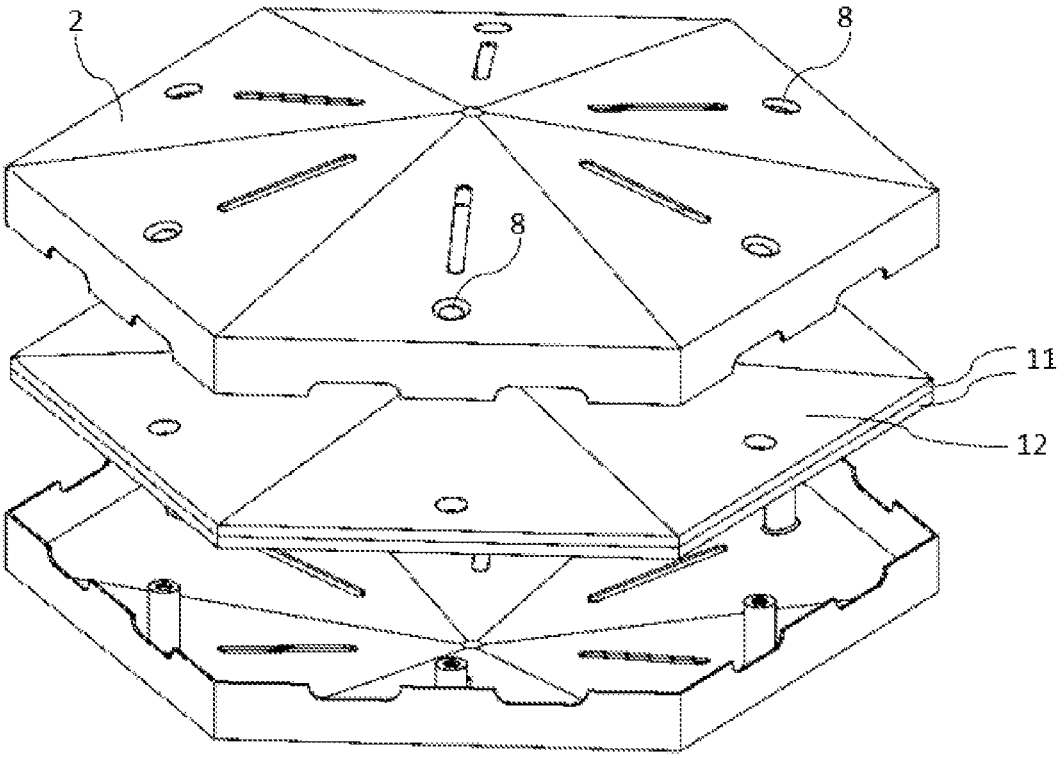

To go into greater detail, reference is made to FIGS. 2A and 2B. The exploded views illustrate that the device has an outer shell made up of two equal halves, upper and lower, each half comprising a cover (2) having an outward convexity and edges corresponding to the corners of a hexagon, that is, having the shape of a hexagonal in plan view. Vertical wall surfaces (3) are projected from said edges, having horizontally extending cutouts (4) at each edge (5) of each vertical wall surface (3). Between both halves of the outer shell an inner shell (10) is arranged extending over the entire horizontal plane of the device, thereby defining upper and lower chambers, separated and with equal volumes. More specifically, the inner shell (10) is formed by the upper and lower inner covers (12, 13) that have outward convexity and are joined together by their edges (11), and that define a periphery of the inner shell that matches with the hexagonal shape of the outer shell. In an essential aspect of the device, the inner shell is closed to the atmosphere and contains air inside.

To secure both halves of the outer shell and the inner shell (10), fastening means are arranged in housings (8) in each cover (2), which can be protected by corresponding lids or otherwise sealed.

Figure 3:
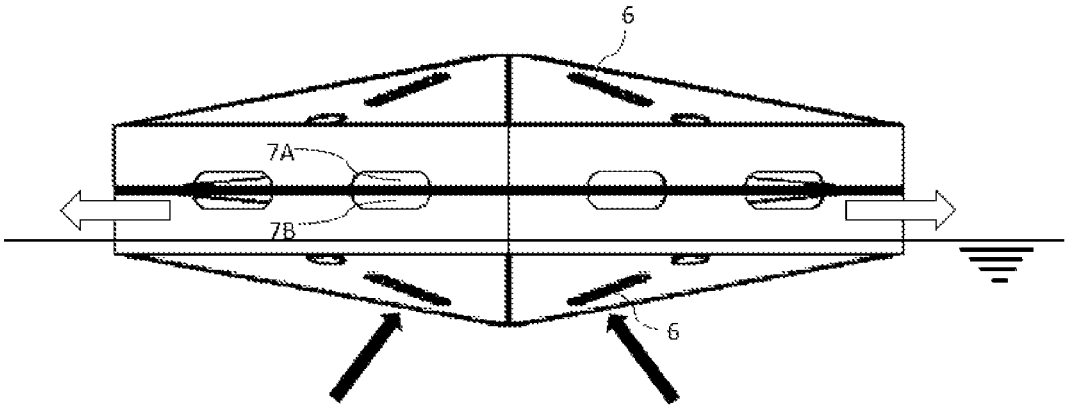
FIG. 3 illustrates an elevation view of the device during its entry into the body of water or liquid.

The first and second chambers allow the entry of air and/or liquid through openings that pass through the outer shell, as shown in FIG. 3. In addition to the cover openings (6), lateral openings (7A, 7B) are provided. The latter, located above and below the edge of the horizontal middle plane, are formed from the cutouts (4) and the separation generated by the edge of the inner shell (10).

FIG. 3 represents the floating device descending in the body of water, before reaching hydrostatic equilibrium. Black and white arrows have been included to represent liquid and air flow, respectively. As shown in the figure, during penetration into the body of water the cover openings (6) and side openings (7B) of the lower half of the device allow the entry of liquid into the lower chamber. This embodiment also illustrates the operation in the event that a device has tipped over. In that case, the liquid outlet from the upper chamber is carried out through the openings (7A), due to gravity and the evacuation slope defined by the convexity of the upper inner cover (12) of the inner shell (10), illustrated in FIG. 2A.

Figure 4:
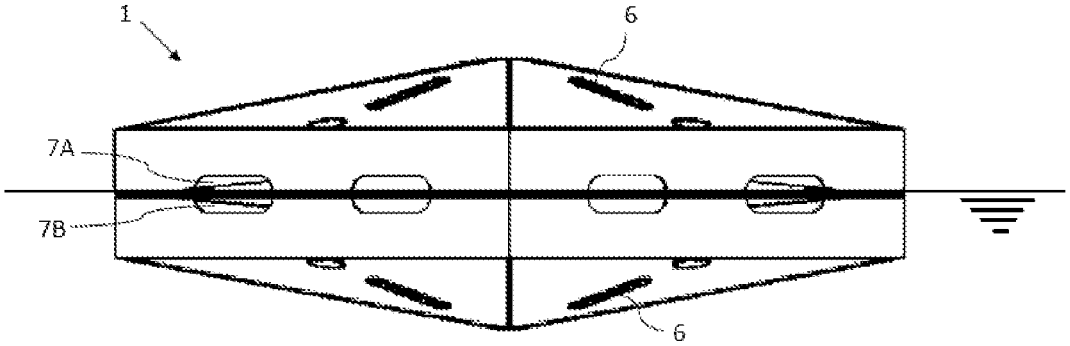
FIG. 4 illustrates an elevation view of the device in stable equilibrium on the body of water or liquid.
Figure 5:
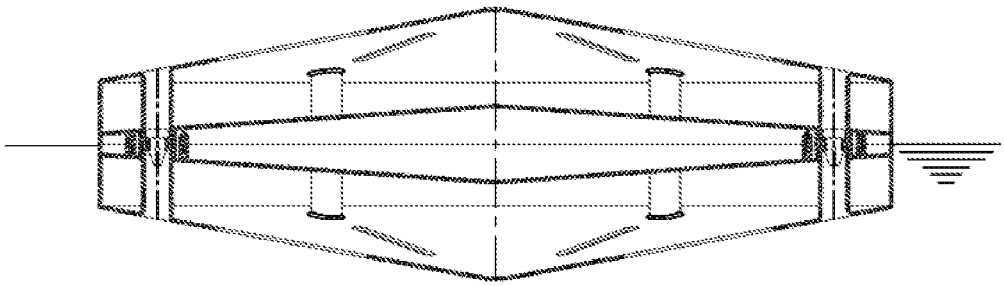
FIG. 5 illustrates a cross-sectional view of the device of FIG. 4.

FIGS. 4 and 5 show the equilibrium position, in which the liquid has filled the lower chamber, providing the necessary ballast for the floating device (1) to remain stable, even against strong winds.

Figure 6:
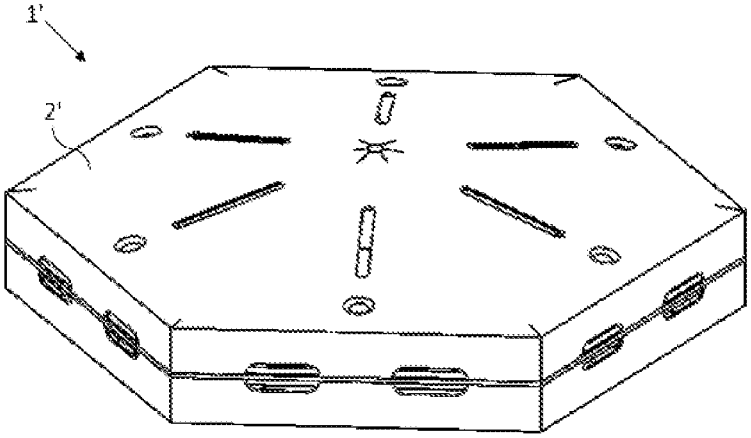
FIG. 6 illustrates a perspective view of a second embodiment of the floating device according to the present invention.
Figure 7:
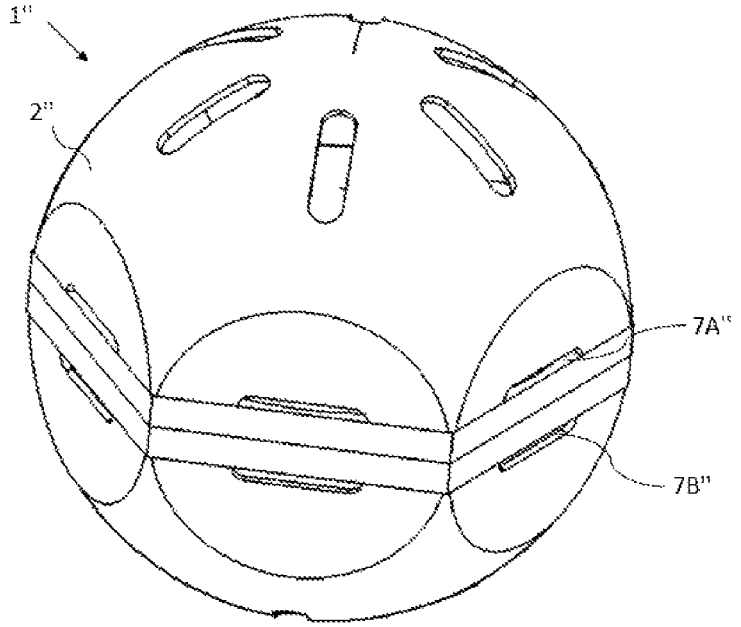
FIG. 7 illustrates a perspective view of a third embodiment of the floating device according to the present invention.
Figure 8:
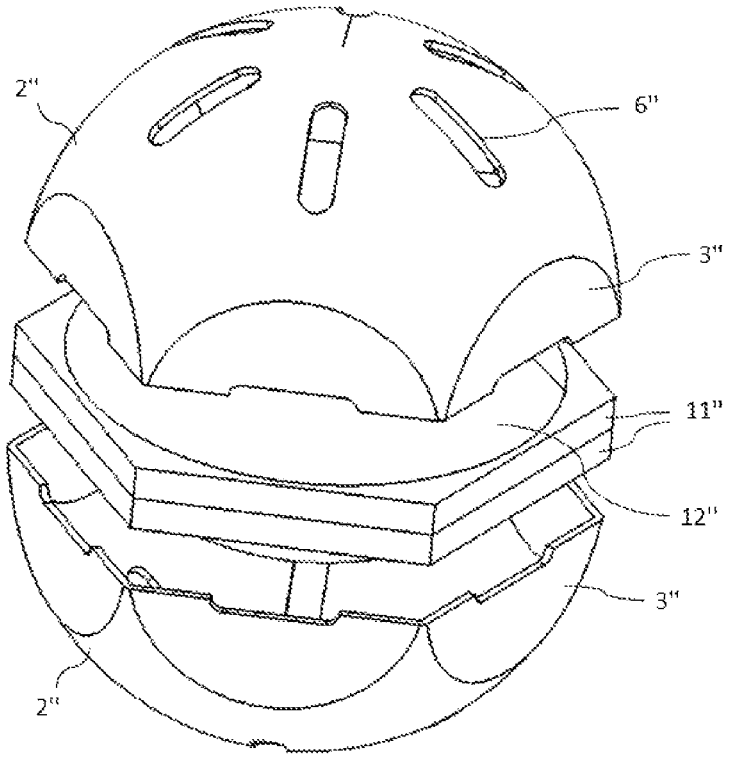
FIG. 8 illustrates an exploded perspective view of the floating device of FIG. 7.

Some variations on the initial model are possible, aimed for example to improve the aerodynamic characteristics. FIG. 6 illustrates a device (1') that has convex covers (2'), which differ from those of the device (1) in that the lines (9) between the center of each cover and the ends of the edges of the hexagon are smoothed or curved. Delving a little deeper into the same concept, in FIGS. 7 and 8 another embodiment is illustrated in which the covers (2") are formed as parabolic or spherical surfaces, wherein to maintain the hexagonal shape in a plan view the vertical wall surfaces (3") are modified so that a curved top edge defined by the intersection with the cover (2") is provided. As illustrated, this embodiment includes openings (6") on the cover, side openings (7A", 7B") for the exchange of air and liquid, an internal shell formed by the covers (12", 13") having also a parabolic or spherical shape, and edges (11") having a horizontal projection to reach the distance to the hexagonal periphery of the device (1").

In yet another embodiment, each half of the outer shell comprises a shell having outward convexity and a square shape in a plan view. Forcing the edges to match the shape of a square is an alternative that does not affect the other aspects of the device, it is only required to specify a similar configuration for the periphery of the inner shell. In the same sense, any regular polygonal shape can be provided in plan view, but many polygonal shapes do not meet the requirement of being able to form a floating cover capable of protecting the entire surface under ideal conditions.

In addition, in each embodiment it is possible to improve, smooth or rounding the edges, with the advantage of reducing the effect of collisions between devices and improving the aerodynamics of the device. Particularly, this applies to the edges between the cover and the vertical wall surfaces, and to the edges between adjacent vertical wall surfaces.

Regarding the size of the device, it is necessary for each final design to consider the amount of momentum generated by the interaction with the wind, so as to maintain the weight achieved within levels of structural safety against impacts between the floats and with other bodies.

With regard to the material for its manufacture, by selecting a material comprising at least one polymer with or without additives to resist ultraviolet radiation (UV), the polymer being selected from polyethylene or polypropylene, the float is capable of tolerating high or low pH, strong temperature gradients and exposure to solar radiation. In addition, due to its shape, it is capable of capturing precipitation and directing it to the protected liquid.

Polypropylene is recommended along with additives to resist UV radiation. This combination allows tolerance to high alkalinity, acidity, temperature gradients and exposure to solar radiation.

In order to minimize loss of water by evaporation from the water volume, a dark color can be provided in at least one of the covers of the inner shell (10).

Based on the foregoing, the various aspects and embodiments of the present invention allow claiming a floating device to be used in groups, forming a cover that floats over volumes of water or liquids that can be used in industry, mining and agriculture, directed to reduce evaporation, algae formation and gas emanation, the device comprising an external shell consisting of covers with outward convexity and lateral edges that form a polygonal shape in a plan view, vertical wall surfaces (3, 3") extending from the edges of the covers, wherein each vertical wall surface (3, 3") joins at the level of a middle plane of the device with the edges of an internal shell (10), wherein: the inner shell (10) is formed by upper and lower inner covers (12, 13, 12", 13") having an outward convexity and join together at their periphery, defining a closed volume filled of air; the inner shell (10) extends throughout the middle plane of the device defining upper and lower chambers, separated and with equal volumes, that are located between said inner shell and the covers of the outer shell; and openings (6, 6") in the covers and lateral openings (7A, 7B) located above and below the horizontal middle plane, which communicate each upper and lower chamber with the environment independently for the exchange of air and liquid.

In one embodiment, the lateral edges of the outer shell covers of the device have a hexagonal shape in a plan view.

In another embodiment, the lateral edges of the outer shell covers of the device have a square shape in a plan view.

In the different embodiments of the device, the upper and lower inner covers (12, 13, 12", 13") of the inner shell (10) are joined by edges (11, 11"). In addition, the edges (11") are flattened and extend horizontally.

In a preferred embodiment, the vertical wall surfaces (3, 3") have cutouts (4), and the side openings (7A, 7B, 7A", 7B") are formed by the cutouts (4) and the edges (11, 11") of the inner shell (10).

Optionally, the device comprises fastening means arranged in housings (8) in each outer shell cover to fix the outer shell and the inner shell (10) to each other.

In one embodiment the device is made of a material comprising polypropylene and additives to resist UV radiation.

In an alternative embodiment of the device, a dark color is provided in at least one of the inner shell covers (10).

In another alternative embodiment of the device, the closed volume within the inner shell (10) further comprises an insulating foam.

Advantages

The configuration of the internal shell (10), extended throughout the horizontal middle plane, closed to the atmosphere and with air inside, provides buoyancy and thermal insulation characteristics. The latter applies both to the liquid that operates as ballast and to the body of water that is protected. The accumulation of water on the internal shell will be minimal since the slope provided by the convexity of the covers facilitates its exit. Therefore, the efficiency in avoiding evaporation, gas emanation and algae formation is a fundamental improvement of the invention.

The solution provided by this device is easy to use. By not having covers that are different it is impossible to introduce the device in a wrong manner in a body of water. On the other hand, although the configuration of both covers of the outer shell is the same, they work in different ways, since one of them, corresponding to the face that contacts the body of water, allows the entry of liquid to provide stability to the device, whereas the upper face allows an interaction with air currents and rainwater, and its release to the body of water, preventing the device from sinking.

The outer shell, along with having an aerodynamic profile, allows to group floats in a compact way, especially when interacting with the wind, allowing an effective coverage of the body of water. This feature is clearly appreciated in the hexagonal and square shape embodiments.

REFERENCE LIST

1, 1', 1" floating device
2, 2', 2" cover
3, 3" vertical wall surfaces
4 cutouts
5 edges
6, 6" openings (cover)
7A, 7B, 7A", 7B" side openings
8 housings (for fastening means)
9 lines (between cover planes)
10 inner shell
11" edges (of the inner shell)
12, 12" upper inner cover (of the inner shell)
13, 13" lower inner cover (of the inner shell)

The invention claimed is:

1. A floating device to be used in groups to form a floating cover that floats over volumes of water or liquids used in industry, mining and agriculture, directed to reduce evaporation, algae formation and gas emanation, comprising an external shell consisting of covers with outward convexity and lateral edges having a polygonal shape in a plan view, vertical wall surfaces extending from the edges of the covers, wherein each vertical wall surface joins at the level of the middle plane of the device with the edges of an inner shell, wherein:

the inner shell is formed by upper and lower inner covers having an outward convexity and that join together at their periphery, defining a closed volume filled with air;

the inner shell extends throughout the middle plane of the device, over an entire horizontal middle plane of the device, thereby defining upper and lower chambers, separated, and with equal volumes, which locate between said inner shell and the covers of the outer shell; and openings in the covers and lateral openings located above and below the horizontal middle plane, communicating each upper and lower chamber with the environment independently for the exchange of air and liquid;

wherein openings in the upper inner cover define a liquid outlet, allowing liquid to exit due to gravity and an evacuation slope defined by the outward convexity of the upper inner cover of the inner shell.

2. The device according to claim 1, wherein the lateral edges of the outer shell covers have a hexagonal shape in a plan view.

3. The device according to claim 1, wherein the lateral edges of the outer shell covers have a square shape in a plan view.

4. The device according to claim 1, wherein the upper and lower inner covers of the inner shell are joined by edges.

5. The device according to claim 1, wherein the edges are flattened and extend horizontally.

6. The device according to claim 5, wherein the vertical wall surfaces have cutouts, and the side openings are formed from the cutouts and the edges of the inner shell.

7. The device according to claim 1, comprising fastening means arranged in housings in each cover of the outer shell to fix the outer shell and the inner shell to each other.

8. The device according to claim 1, wherein the device is made of a material comprising at least one polymer with or without additives to resist ultraviolet radiation.

9. The device according to claim 1, wherein at least one of the inner shell covers is dark in color.

10. The device according to claim 1, wherein the closed volume within the inner shell further comprises insulating foam.

* * * * *